US012740656B2

(12) United States Patent
Goodwill et al.

(10) Patent No.: US 12,740,656 B2
(45) Date of Patent: Sep. 22, 2026

(54) ROCKER/BOUNCER FOR A CHILD

(71) Applicant: Mamas & Papas (Holdings) Limited, Huddersfield (GB)

(72) Inventors: Nick Goodwill, Huddersfield (GB); Peter Smith, Huddersfield (GB)

(73) Assignee: Mamas & Papas (Holdings) Limited, Huddersfield (GB)

( * ) Notice: Subject to any disclaimer, the term of this patent is extended or adjusted under 35 U.S.C. 154(b) by 96 days.

(21) Appl. No.: 18/854,367

(22) PCT Filed: Mar. 23, 2023

(86) PCT No.: PCT/EP2023/057443
§ 371 (c)(1),
(2) Date: Oct. 4, 2024

(87) PCT Pub. No.: WO2023/194112
PCT Pub. Date: Oct. 12, 2023

(65) Prior Publication Data

US 2025/0241457 A1 Jul. 31, 2025

(30) Foreign Application Priority Data

Apr. 5, 2022 (GB) ..... 2205004

(51) Int. Cl.
*A47D 13/10* (2006.01)

(52) U.S. Cl.
CPC ..... *A47D 13/107* (2013.01); *A47D 13/102* (2013.01)

(58) Field of Classification Search
CPC ..... A47D 13/102; A47D 13/107; A47D 13/10
See application file for complete search history.

(56) References Cited

U.S. PATENT DOCUMENTS 3,692,359 A * 9/1972 Boucher ..... A47D 13/043 280/30
8,079,639 B2 * 12/2011 Zeng ..... A47D 13/102 297/133

(Continued)

FOREIGN PATENT DOCUMENTS

CN 104523074 A * 4/2015 ..... A47D 13/10
JP 2005080894 A 3/2005

OTHER PUBLICATIONS

English translation for CN-104523074-A (Year: 2015).*

(Continued)

*Primary Examiner* — David R Dunn
*Assistant Examiner* — Troy Alan Libby
(74) *Attorney, Agent, or Firm* — MacMillan, Sobanski & Todd, LLC

(57) ABSTRACT

A rocker/bouncer for a child is provided. The rocker/bouncer includes a base, the base includes one or more rails on which the rocker/bouncer can rock when the base on placed on a ground surface; a seat for the child, the seat is coupled to the base by a resilient member, e.g. to permit bouncing of the seat relative to the base; and an adjustment member movably coupled to the base, the adjustment member is selectively movable between: a stowed position; a first deployed position, in which the adjustment member protrudes from the one or more rails towards the ground surface by a first distance; and a second deployed position, in which the adjustment member protrudes from the one or more rails towards the ground surface by a second distance different from the first distance.

8 Claims, 6 Drawing Sheets

(56) References Cited

U.S. PATENT DOCUMENTS

| | | | | |
|---|---|---|---|---|
| 11,684,177 | B2 * | 6/2023 | Rogers | A47D 1/08 297/118 |
| 2006/0001301 | A1 | 1/2006 | Caldwell | |
| 2007/0040430 | A1 | 2/2007 | Flannery | |
| 2011/0260507 | A1 | 10/2011 | Parness et al. | |
| 2016/0037942 | A1 * | 2/2016 | Guozhu | A47D 13/107 297/274 |
| 2017/0251831 | A1 | 9/2017 | Perrin | |

OTHER PUBLICATIONS

Great Britain Examination Report, Application No. GB2205004.1, dated Feb. 20, 2024.
Great Britain Search Report, Application No. GB2205004.1, dated Oct. 4, 2022.
International Search Report and Written Opinion, Application No. PCT/EP2023/057443, dated Jun. 28, 2023.

* cited by examiner

ROCKER/BOUNCER FOR A CHILD

TECHNICAL FIELD

The present disclosure relates to a rocker/bouncer for a child and is particularly, although not exclusively, concerned with a rocker/bouncer for a child which enables the inclination of a seat of the rocker/bouncer to be selectively varied.

BACKGROUND

Chairs with rocking and/or bouncing functions, typically referred to as rocker/bouncers, are often used by parents for seating young children. Such chairs regularly comprise a toy bar or other structure for supporting toys above and optionally, within reach of, the child. Rocker/bouncers typically provide a reclined seating position for the child, from which they can interact with the toys suspended from the toy bar, or other supporting structure. The rocking and/or bouncing motion of the chair can also be soothing to the child and can be used to encourage the child to sleep.

Although chairs for children providing rocking and/or bouncing functions can be desirable in some situations. Chairs providing such functions are often less suitable in other situations, for example, when direct interaction between parent and child is desirable.

STATEMENTS OF INVENTION

According to an aspect of the present disclosure, there is provided a rocker/bouncer for a child, the rocker/bouncer comprising: a base, wherein the base comprises one or more rails on which the rocker/bouncer can rock when the base on placed on a ground surface; a seat for the child, wherein the seat is coupled to the base by a resilient member, e.g. to permit bouncing of the seat relative to the base; and an adjustment member movably coupled to the base, wherein the adjustment member is selectively movable between: a stowed position; a first deployed position, in which the adjustment member protrudes from the one or more rails towards the ground surface by a first distance; and a second deployed position, in which the adjustment member protrudes from the one or more rails towards the ground surface by a second distance different from the first distance.

The adjustment member is securable, e.g. selectively securable, in the stowed position, the first deployed position and the second deployed position, e.g. such that movement of the adjustment member away from the position is restricted.

The adjustment member may be configured to contact the ground surface when in the first and second deployed positions in order to adjust an angle of inclination of the seat relative to the ground surface, e.g. compared to when the adjustment member is in the stowed position.

The adjustment member may be rotatably coupled to the base. The adjustment member may be rotatable relative to the base between the stowed position and the first and second deployed position. The first deployed position of the adjustment member may be at an angle of approximately 180 degrees relative to the second deployed position. In other words, the adjustment member may be rotated through an angle of approximately 180 relative to the base in order to move between the first and second deployed positions.

The base may comprise a foot portion. When the adjustment member is in the stowed position, the rocker/bouncer may be able to rock on the one or more rails between a first position in which the foot portion contacts the ground surface, and a second position, in which the foot portion does not contact the ground surface.

When the adjustment member is in the first deployed position, the adjustment member and foot portion are configured to contact the ground surface to resist rocking of the rocker/bouncer on the rails.

When the adjustment member is in the second deployed position, the adjustment member, the foot portion and a further foot portion, or portion of the base on an opposite side of the foot portion from the adjustment member, e.g. forwards of the foot portion, are configured to contact the ground surface simultaneously to resist rocking of the rocker/bouncer on the rails and support the seat in an inclined orientation, e.g. relative to when the adjustment member is in the stowed position or first deployed position.

The portion of the base on the opposite side of the foot portion from the adjustment member may be shaped such that the portion is in contact with the ground surface along a continuous length of the portion between the foot and a forward extent of the base.

The rocker/bouncer may further comprise a resilient connecting portion arranged to couple the seat portion to the base portion. The resilient connecting portion may be at a rearward extent of the rocker/bouncer. The rocker/bouncer may be free from connections between the seat and the base at positions on the seat forwards of a central position of the rocker/bouncer, e.g. a position midway between forward and rearward extents of the rocker/bouncer.

To avoid unnecessary duplication of effort and repetition of text in the specification, certain features are described in relation to only one or several aspects or embodiments of the invention. However, it is to be understood that, where it is technically possible, features described in relation to any aspect or embodiment of the invention may also be used with any other aspect or embodiment of the invention.

BRIEF DESCRIPTION OF THE DRAWINGS

For a better understanding of the present invention, and to show more clearly how it may be carried into effect, reference will now be made, by way of example, to the accompanying drawings, in which.

DETAILED DESCRIPTION

Figure 1:
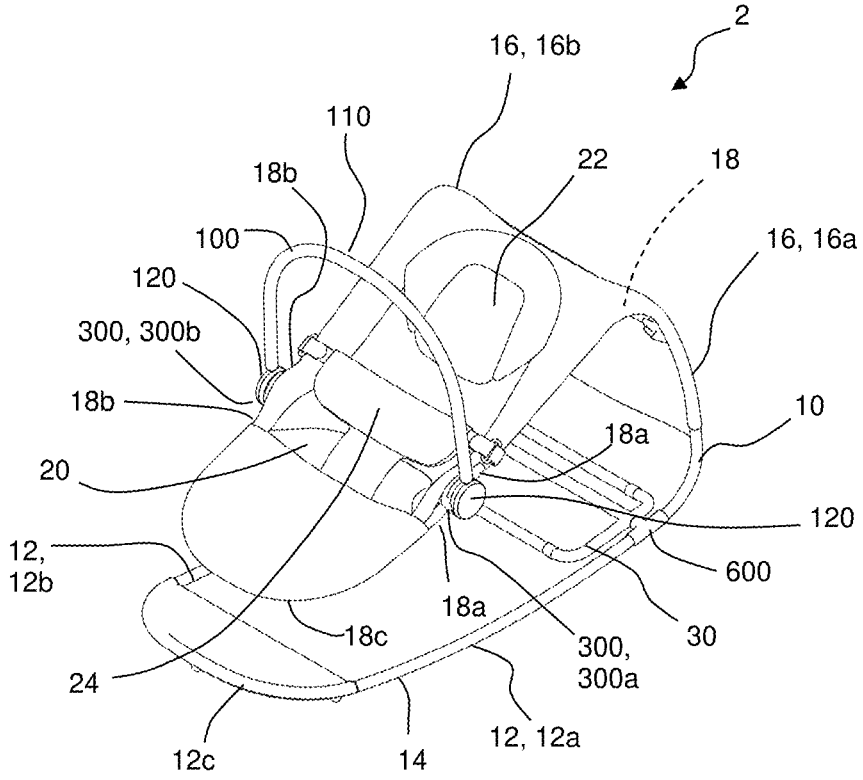
FIG. 1 is a perspective view of a rocker/bouncer for a child according to arrangements of the present disclosure with a stand in a first configuration.

With reference to FIGS. 1 and 2, furniture for a child, according to arrangements of the present disclosure, such as a rocker/bouncer 2, may comprise a frame 10, a seat 20, and a stand 30. The seat 20 may form a support for supporting the child on the furniture. In particular, the seat 20 may be for supporting the child to face in a forward direction of the rocker/bouncer 2. The frame 10 may be configured to support the seat 20 in a suitable position for the child to sit and/or lie on.

As depicted, the rocker/bouncer 2 further comprises a toy bar 100 for supporting toys on the rocker/bouncer 2. In particular, the toy bar 100 may be arranged to support toys above, or adjacent to the seat 20. As described in greater detail below, the toy bar 100 may be magnetically couplable to the frame 10 and/or the seat 20.

The frame 10 comprises one or more base frame members 12, which at least partially form a base 14 for the rocker/bouncer to be placed on a ground surface, e.g. in use of the rocker/bouncer 2. As depicted, the base frame members 12 may form rails 12*a*, 12*b* on which the rocker/bouncer can rock over the ground surface. The rails 12*a*, 12*b* may be curved along at least a part of their length, and the curved shape of the rails 12*a*, 12*b* may enable the rocking motion of the rocker/bouncer 2.

In the arrangement shown, the frame 10 comprises a single base frame member 12 which is shaped, e.g. bent, to form first and second rails 12*a*, 12*b* on respective lateral sides of the base 14 of the rocker/bouncer. As depicted, the base frame member 12 comprises a bend portion 12*c* extending between the first and second rails 12*a*, 12*b*. The bend portion 12*c* of the base frame member may comprise a curved portion of the base frame member 12 at which the base frame member is curved through an angle of approximately 180 degrees between the rails 12*a*, 12*b*. The first and second rails 12*a*, 12*b* may extend along either lateral side of the frame, and/or the rocker/bouncer. The first and second rails 12*a*, 12*b* may extend substantially parallel with one another. Alternatively, the first and second rails 12*a*, 12*b* maybe angled relative to one another, such that a distance between the first and second rails changes, e.g. increases or decreases, between forward and rearward extents of the first and second rails 12*a*, 12*b*.

As depicted, the bend portion 12*c* may form a forward extent of the frame 10, and optionally, the rocker/bouncer. In the arrangement depicted, the bend portion 12*c* and the first and second rails 12*a*, 12*b* are integrally formed. However, in other arrangements, the bend portion 12*c* and the first and second rails 12*a*, 12*b* may be detachably coupled together.

The frame 10 may further comprise one or more connecting frame members 16 for connecting the base 14, e.g. the one or more base frame members 12, to one or more seat support frame members 18. In the arrangement depicted, the frame 10 comprises two connecting frame members 16*a*, 16*b* for respectively connecting the first and second rails 12*a*, 12*b* to the one or more seat support frame members 18, e.g. to respective seat support frame members. The two connecting frame members 16 may be arranged on first and second lateral sides of the frame 10 respectively. The connecting frame members 16 may be resilient, e.g. by virtue of the shape and/or material of the connecting frame members. For example, the connecting frame members 16 may comprise curved or bent tubes formed from a resilient material, such as a metal or polymer material. The resilient nature of the connecting frame members 16 may enable bouncing motion of the seat 20 relative to the base 14.

In the arrangement depicted, the connecting frame members 16 are detachably couplable to the base frame member 12, e.g. via one or more push fit connectors 600.

However in other arrangements, the connecting frame members 16 may be integrally formed with the base frame members, e.g. with respective base frame members 12.

As depicted, the seat support frame members 18 may comprise one or more first side seat support frame members 18*a* for supporting a first lateral side of the seat 20, and one or more second side seat support members 18*b* for supporting a second lateral side of the seat 20 opposite the first side. The seat support frame members 18 may further comprise a front seat support frame member 18*c* extending between the first and second side seat support frame members at a front end of the seat 20. In some arrangements, the front seat support frame member 18*c* may be integrally formed with one of the first side seat support frame members 18*a* and one of the second side seat frame members 18*b*. Alternatively, the front seat support frame member 18*c* may be connected, e.g. detachably connected, to the one of the first side seat support frame members 18*a* and the one of the second side seat frame members 18*b*.

As depicted, one of the first side seat support frame members 18*a* and one of the second side seat support frame members 18*b* may be integrally formed with respective ones of the coupling frame members 16. For example, one of the first side seat support frame members 18*a* may be integrally formed with one of the coupling frame members 16*a* arranged on the first lateral side of the frame and one of the second side seat support frame members 18*b* may be integrally formed with one of the couple frame members 16*b* arranged on the second lateral side of the frame.

As depicted, the rocker/bouncer may be free from connections between the seat 20, e.g. the seat support frame members 18, and the base 14 at the front end of the seat/frame, e.g. at positions on the seat forwards of a central position of the rocker/bouncer or frame thereof.

The frame 10 may further comprise one or more toy bar connecting portions, e.g. toy bar hubs 300, which are described in greater detail below. For example, the frame 10 may comprise first and second toy bar hubs 300*a*, 300*b* provided on opposing lateral sides of the frame 10. As depicted, the first toy bar hub 300*a* may be coupled to one or more of the first side seat support frame members 18*a* and the second toy bar hub 300*b* may be coupled to one or more of the second side seat support frame members 18*b*. In the arrangement shown, the frame 10 comprises two first side seat support frame members 18*a*, which are coupled together via the first toy bar hub 300*a* and two second side seat support frame members 18*b*, which are coupled together via the second toy bar hub 300*b*. In other arrangements, the toy bar connecting portions may be provided on, e.g. (directly) connected to or integrally formed with, the seat 20.

The seat 20 may be supported by the seat support frame members 18. For example, the seat 20 may be supported between two seat support frame members 18 provided on either lateral side of the frame. Optionally, as depicted in FIGS. 1 and 2, the seat 20 may be partially supported by the coupling frame members 16. In some arrangements, the seat may comprise resiliently deformable material, such as fabric and/or polymer materials, which may be configured to resiliently deform in order to adopt an ergonomic shape to receive the child on the seat. The seat 20 may be removably couplable to the frame 10, e.g. to the seat support frame members 18. For example, the seat support frame members 18 may comprise tubular frame members, and the seat 20 may comprise portions configured to extend about the tubular frame members, such as loops of material, in order to couple the seat 20 to the frame 10.

As depicted, the seat 20 may further comprise a head cushion 22 for supporting a child's head, when the child is sitting or lying on the seat 20. The seat 20 may further comprise a restraint 24 for securing the child in the seat 20.

The toy bar 100 comprises a bar part 110 and one or more connecting parts 120 fixedly coupled to, or integrally formed with, the bar part 110. In the arrangement depicted, the toy bar 100 comprises one connecting part 120 at each end of the bar part 110. However, in other arrangements, a different number of connecting parts 120 may be provided, which may be connected to the bar part 110 in a different arrangement. The connecting parts 120 of the toy bar 100 are connectable to the frame 10 and/or the seat 20, e.g. to the toy bar hubs 300, such that the bar part 110 is arranged relative to the seat 20 of the rocker/bouncer 2 and so that toys can be attached to the bar part 110 to be suspended within reach of a child sat or lying in the seat 20. As described herein, the toy bar 100 may be magnetically coupleable to the frame and/or seat.

Figure 2A:
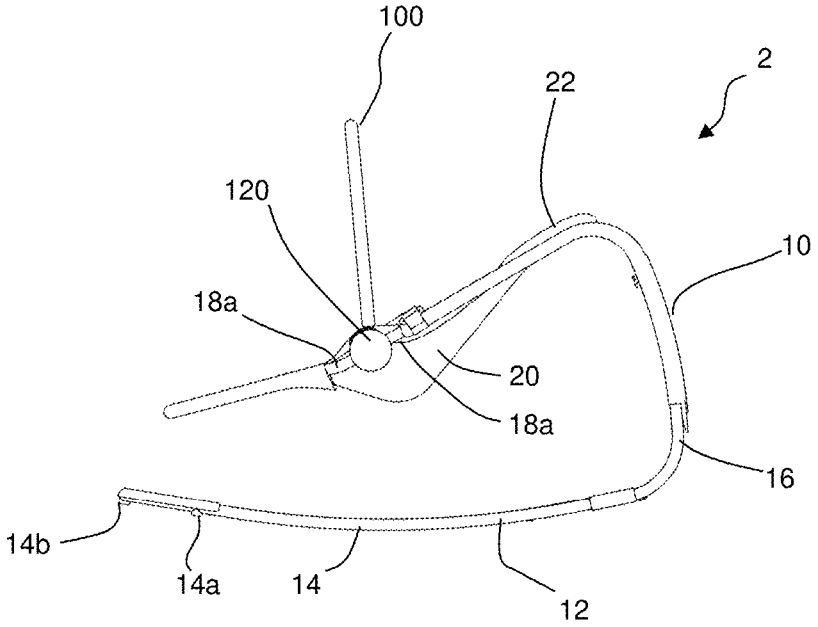
FIGS. 2*a* and 2*b*, collectively referred to as FIG. 2, are side views of the rocker/bouncer for a child, according to arrangements of the present disclosure, having a toy bar arranged in first and second configurations respectively.

The toy bar 100 may be configured to couple to the frame 10 and/or the seat 20 in a first configuration/position, depicted in FIG. 2*a*. When the toy bar 100 is in the first configuration, at least a portion of the toy bar, e.g. of the bar part 110, may be positioned on an opposite side of the seat 20 from the base 14. In this way, the toy bar 100 may be arranged to support toys above a child sat or lying in the seat 20. In the first configuration, the toy bar 100, e.g. bar part 110 of the of the toy bar, may be arranged at an angle relative to a particular frame member of the frame 10, such as a particular seat support frame member 18. For example, the bar part may be arranged at an angle of between approximately 45 degrees and 135 degrees relative to the particular frame member, such as at approximately 90 degrees relative to the particular frame member.

Figure 2B:
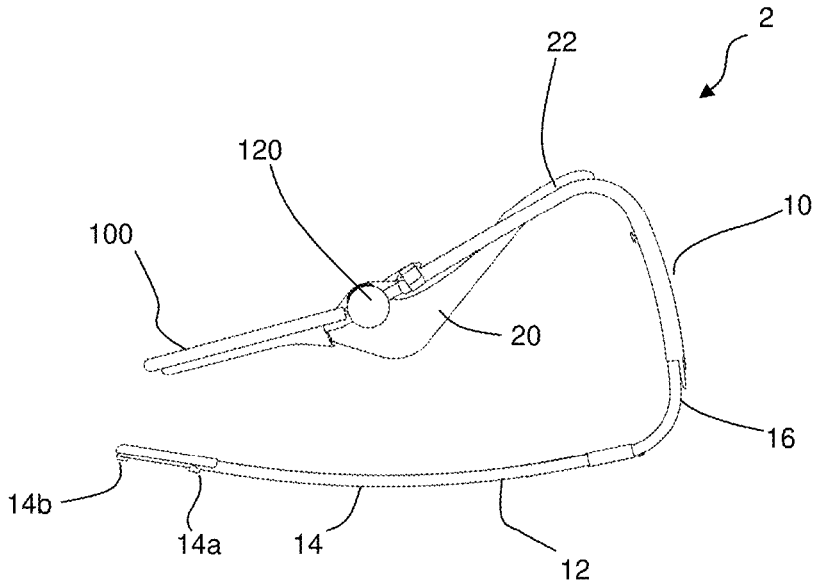

The toy bar 100 may also be configured to couple to the frame 10 and/or the seat 20 in a second configuration/position, depicted in FIG. 2*b*. When the toy bar 100 is in the second configuration, the toy bar 100, e.g. bar part 110 of the of the toy bar, may be more closely aligned with the frame member of the frame 10, such as the particular seat support frame member 18. When the toy bar 100 is in the second configuration, the toy bar 100, e.g. the bar part 110, may be arranged adjacent to a particular seat support frame member 18, such as the front seat support member 18*c* along a length, e.g. a predominant length of the bar part. The toy bar 100, e.g. the bar part 110, may be arranged in contact with the seat support member, e.g. the front seat support member 18*c*, along the length of the toy bar. Alternatively, the toy bar, e.g. the bar part, may be arranged such that the toy bar is spaced apart from the seat support member, e.g. the front seat support member, by a substantially constant distance along the length of the toy bar. Arranging the toy bar 100 in the second configuration may improve access for the child to be placed into the seat 20, e.g. so that the child can be placed into the seat more easily.

Figure 5:
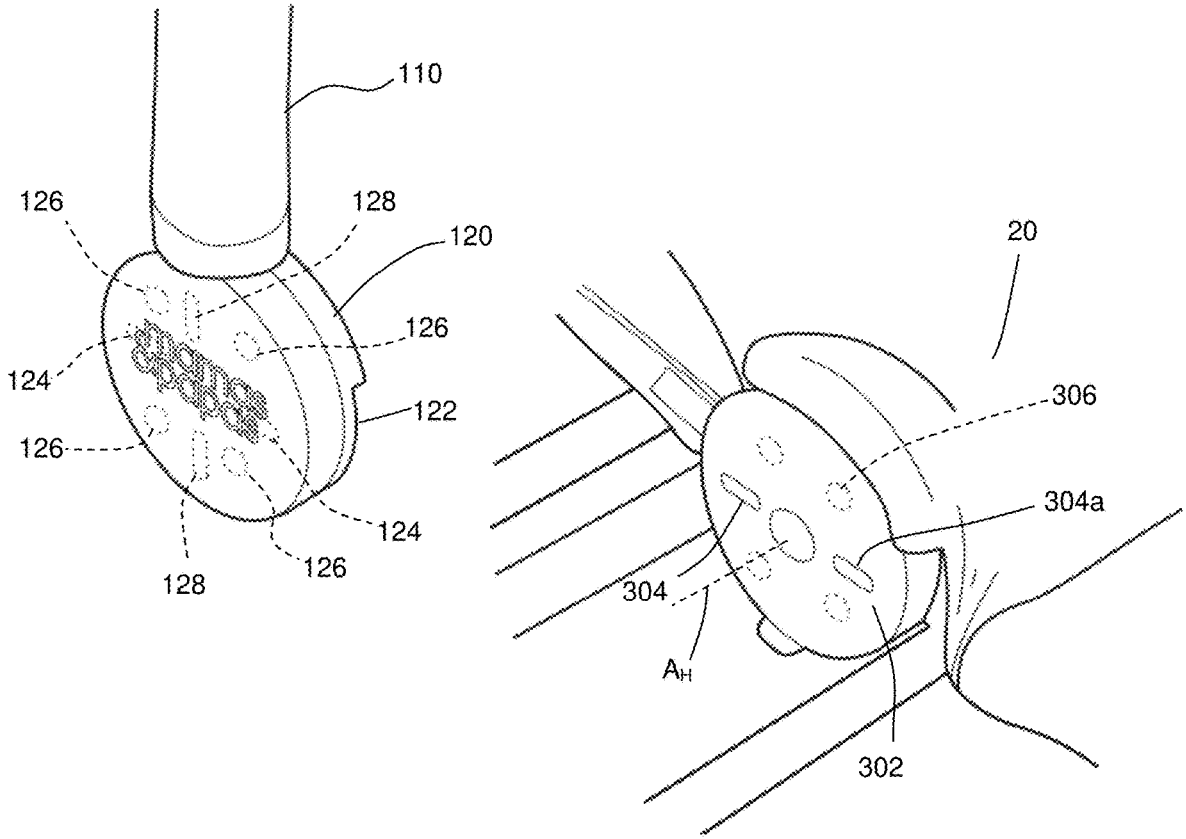
FIG. 5 is a partial, perspective view of the rocker/bouncer for a child according to arrangements of the present disclosure.

Referring now to FIG. 5, the connecting parts 120 of the toy bar may comprise an engagement face 122 and the toy bar connection portion, e.g. the hub 300, may comprise a complementary engagement face 302. The rocker/bouncer may be configured such that the engagement face 122 engages the complementary engagement face 302 when the toy bar 100 is coupled to the frame 10 and/or seat 20, e.g. at the toy bar hubs 300.

As mentioned above, the toy bar 100 may be magnetically couplable to the frame 10 and/or seat 20. In particular, one or more toy bar magnets 126 may be coupled to connecting parts 120 of the toy bar, and one or more hub magnets 306 may be coupled to the toy bar connection portions 300. The toy bar magnets 126 and the hub magnets 306 may be configured such that the engagement face 122 is held against the complementary engagement face by virtue of the magnets. The toy bar magnets 126 and the hub magnets 306 may be configured to resist disengagement of the engagement face 122 from the complementary engagement face 302. In particular, the toy bar magnets 126 and/or the hub magnets 306 may be configured to resist movement of the toy bar relative to the frame 10 and/or seat 20 in a first direction, e.g. perpendicular to the engagement face 122 and/or complementary engagement face 302.

In the arrangement depicted in FIG. 5, the toy bar magnets 126 are embedded within the connecting parts 120 of the toy bar. For example, the toy bar magnets may be embedded in the connecting parts through an overmoulding manufacturing process. Similarly, the hub magnets 306 may be embedded within the toy bar connection portion 300. For example, the hub magnets 306 may be embedded within the toy bar connection portion 300 through an overmoulding manufacturing process. Alternatively, the toy bar magnets 126 may be otherwise coupled to the connecting parts 120 and/or the hub magnets 306 may be otherwise coupled to the toy bar connection portions 300. For example, the magnets may be received within recesses formed in the components and may be secured in the recesses by virtue of an interference fit, mechanical fasteners, and/or an adhesive.

In the arrangements depicted in FIG. 5, the connecting parts 120 of the toy bar comprise four toy bar magnets 126 and the toy bar connecting portions 300 comprise four hub magnets 306 arranged such that ones of the hub magnets 306 are substantially aligned with ones of the toy bar magnets 126 when the toy bar is arranged in the first and second positions. In other arrangements, the connecting parts 120 and toy bar connecting portions 300 may comprise any other number of magnets, such as one, two, three, or more than four magnets. For example, in one arrangement, the toy bar comprises one toy bar magnet 126 and the toy bar connecting portions 300 comprise one hub magnet 306. The toy bar magnets 126 and the hub magnets 306 are arranged so as to be at least partially aligned when the toy bar is in the first and second positions and optionally in one, more than one or each position between the first and second positions. The toy bar magnets 126 and the hub magnets 306 may remain at least partially aligned as the toy bar moves between the first and second positions. For example, the toy bar magnets 126 and the hub magnets 306 may be positioned substantially centrally on the connecting parts 120 and the toy bar connecting portions 300 respectively, e.g. with respect to an axis about which the toy bar is rotated between the first and second positions. In some arrangements, the connecting parts 120 and toy bar connecting portions 300 may comprise different numbers of magnets from one another.

The toy bar magnets 126 and hub magnets 306 may be configured such that the engagement face 122 is held against the complementary engagement face 302 by virtue of the magnets when the toy bar is in the first configuration depicted in FIG. 2*a*, and when the toy bar is in the second configuration depicted in FIG. 2*b*. In some arrangements, the toy bar magnets 126 and hub magnets 306 may be configured such that the engagement face 122 is held against the complementary engagement face by virtue of the magnets in one or more intermediate positions of the toy bar between the first and second configurations.

Although in the arrangements described above, magnets are provided on the connecting parts 120 of the toy bar and on the toy bar connection portions 300, it will be appreciated that one or more of the magnets on either of the parts may be replaced by elements of a magnetically attractive material, such as a ferromagnetic material. In such arrangements, the magnetically attractive material may be shaped such that the engagement face 122 is held against the complementary engagement face by virtue of the magnetic attraction between magnets and the elements of magnetically attractive material in the first and second configurations of the toy bar, and optionally, one or more intermediate positions between the first and second configurations.

The engagement face 122 and the complementary engagement face 302 may be substantially planar. For example, a majority of the areas of the engagement face 122 and the complementary engagement face 302 may be substantially planar, e.g. forming part of a flat or curved plane. As depicted in FIG. 5, the engagement face 122 and the complementary engagement face 302 may be substantially circular. However, in other arrangements, the engagement face and/or the complementary engagement face may be any other desirable shape, such as triangular, square, oval, oblong, hexagonal or any other shape.

The complementary engagement face 302 may be substantially vertical, e.g. when the base 14 of the rocker/bouncer is positioned on a horizontal surface, such as standing on the ground. As depicted, the plane of the complementary engagement face may be normal to a lateral direction of the rocker/bouncer. The engagement face 122 and the complementary engagement face 302 may therefore engage one another in the vertical plane normal to the lateral direction of the rocker/bouncer. When the rocker/bouncer comprises more than one complementary engagement face 302, the complementary engagement faces may be parallel with one another. The toy bar 100 may thereby be rotatable about a horizontal axis $A_H$ in a lateral direction of the rocker/bouncer whilst the engagement face 122 remains in engagement with the complementary engagement face 302.

The toy bar connection portion 300 may comprise one or more protruding portions 304, which may protrude outwardly relative to the complementary engagement face 302. The connecting part 120 may comprise a corresponding number of recesses 124 for receiving the one or more protruding portions 304 when the toy bar 100 is connected to the seat and/or frame in the first configuration. The protruding portions 304 and the recesses 124 may be configured to engage one another in order to resist movement, e.g. translations and/or rotations of the toy bar 100 relative to the frame 10 and seat 20. The protruding portions 304 and the recesses 124 may resist movement, e.g. translations, of the toy bar 100 relative to the frame 10 and seat 20 in a second direction. The second direction may be perpendicular to the first direction. Additionally or alternatively, the protruding portions 304 and the recesses 124 may resist movement, e.g. rotations about an axis having a component in the first direction.

The connecting part 120 may further comprise the corresponding number of further recesses 128 for receiving the protruding portions 304 when the toy bar is arranged in the second configuration. In other words, the further recesses 128 may be configured to receive the one or more protruding portions 304 when the toy bar is in the second position and/or orientation relative to the frame and/or seat. A shape of the further recess 128 may correspond to the shape of the recesses 124 which have been rotated about the horizontal axis $A_H$, e.g. through an angle of approximately 90 degrees or greater than 90 degrees, such as between 90 degrees and 180 degrees.

The one or more protruding portions 304 may comprise angled surface portions 304*a*, e.g. radiused or chamfers surfaces. The angled surface portions may be provided at distal end edges of the protruding portions. The angled surface portions 304*a* may be configured such that when the toy bar 100 is urged to move from the first configuration towards the second configuration, or from the second configuration towards the first configuration, the angled surface portions 304*a* engage surfaces of the recesses 124 or further recesses 128 (depending on the current configurations of the toy bar) and act to urge the protruding portions 304 out of the recesses 124 or further recesses 128. For example, the angled surface portions 304*a* may be arranged to urge the engagement face 122 away from the complementary engagement face 302 when the angled surface portions 304*a* engage the surfaces of the recesses 124 or further recesses 128.

In other arrangements, the angled surface portions may additionally or alternatively be provided on the recesses 124 and further recesses 128 and may be configured to engage the protruding portions 304 when the toy bar 100 is urged to move from the first configuration towards the second configuration, or from the second configuration towards the second configuration, and urge the protruding portions out of the recesses or further recesses.

In the arrangement described above, the one or more protruding portions 304 are provided on the toy bar connection portion 300 and the one or more recesses 124 and further recesses 128 are provided on the connecting part 120. However, in other arrangements, the protruding portions may be provided on the toy bar connection portion 300 and may protrude outwardly relative to the complementary engagement face; and the recesses and further recesses may be formed in the connecting part.

Referring now to FIGS. 2, 3 and 4, the stand 30, which may alternatively be referred to as an adjustment member, may be movably, e.g. pivotally, coupled to the base 14. For example, the stand 30 may be coupled to either or both of the rails 12*a*, 12*b*. In the arrangements depicted, the stand 30 extends laterally across the base 14 of the rocker/bouncer 2 between the rails 12*a*, 12*b* on either lateral side of the base. The stand 30 is movable relative to the base 14 in order to adjust a function of the rocker/bouncer 2. Additionally or alternatively, movement of the stand 30 relative to the base 14 may adjust an angle of inclination of the seat 20 relative to a ground surface on which the base 14 is standing.

The stand 30 may be selectively movable between a stowed position, depicted in FIG. 2; a first deployed position, depicted in FIG. 3; and a second deployed position, depicted in FIG. 4. Further, the stand may be selectively securable in each of the stowed, and first and second deployed positions.

As depicted in FIG. 2, when the stand 30 is in the stowed position, the stand 30 may be at least partially or substantially aligned with a frame member of the frame 10, such as a base frame member 12. When the stand 30 is in the stowed position, the stand may not protrude below a lower extent of the base 14 of the frame, e.g. below the rails 12*a*, 12*b*, relative to a ground surface on which the rocker/bouncer may be placed. Hence, the stand 30 may be positioned to as not to contact the ground surface and/or not affect rocking of the rocker/bouncer over the rails 12*a*, 12*b*.

In contrast to when the stand 30 is in the stowed position, when the stand is in the first or second deployed position, the stand 30 is configured to contact the ground surface, e.g. when the base 14 of the rocker/bouncer is placed on the ground surface, in order to affect the rocking function of the rocker/bouncer 2 and/or in order to adjust an angle of inclination of the rocker/bouncer relative to the ground surface. For example, the stand 30 may be configured to protrude downwards relative to the base 14 of the frame, e.g. the rails 12*a*, 12*b*, when the stand is in the first and second deployed positions.

As depicted, the stand 30 may be positioned on the rocker/bouncer so that the stand 30 protrudes downwards relative to the rails 12*a*, 12*b* at a rearward position on the rocker/bouncer, e.g. rearward of a (geometrically) central position of the frame 10 of the rocker/bouncer.

When the stand 30 is in the first deployed position, the stand 30 may be configured to protrude downwards relative to the base 14, e.g. the rails 12*a*, 12*b*, of the frame 10, e.g. towards the ground surface, by a first distance; and when the stand 30 is in the second deployed position, the stand may be configured to protrude downwards relative to the rails, e.g. towards the ground surface, by a second distance different from, e.g. greater than, the first distance.

The stand 30 may be rotatably coupled to the frame 10, e.g. the base 14 of the frame, at a pivot axis 32. The stand 30 may be rotated relative to the frame 10 between the stowed position, the first deployed position and the second deployed position about the pivot axis 32. The first deployed position of the stand may be at an angle of greater than 90 degrees relative to the second deployed position, such as between 90 degrees and 180 degrees or approximately 180 degrees relative to the second deployed position of the stand 30. The first and second deployed positions may each be at an angle of approximately 90 degrees relative to the stowed position, e.g. in opposite directions.

As depicted, the stand 30 may comprise a first stand portion 34 and a second stand portion 36. At least a part of the first stand portion 34 may be positioned at a first distance away from the pivot axis 32, e.g. in a radial direction of the pivot axis, and at least part of the second stand portion 36 may be positioned at a second distance away from the pivot axis 32. The second distance may be different from, e.g. greater than, the first distance. Further, the first stand portion 34, or part thereof, may be positioned away from the pivot axis in a different direction from the second stand portion 36, or part thereof. For example, the first stand portion 34 may be positioned away from the second stand portion 36 around the pivot axis 32 through an angle of greater than 90 degrees, such as between 90 degrees and 180 degrees, or approximately 180 degrees. The first deployed position may correspond to a position of the stand 30 in which the first stand portion 34 is arranged below the base 14 of the frame and the second deployed position may correspond to a position of the stand in which the second stand portion 36 is arranged below the base 14.

As depicted, the stand 30 may be coupled to the frame 10 by the push fit connectors 600, which are arranged to couple the first and second rails 12*a*, 12*b* to the connecting members 16*a*, 16*b* on the first and second lateral sides of the rocker/bouncer 2 respectively.

Figure 6:
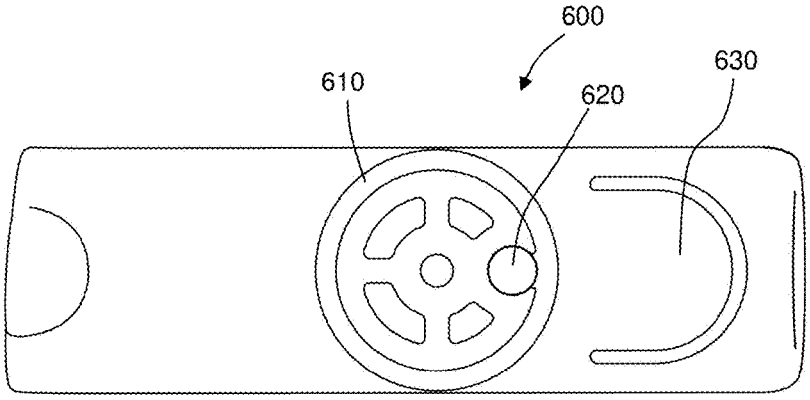
FIG. 6 is a side view of a push fit connector forming part of a frame for the rocker/bouncer.
Figure 7:
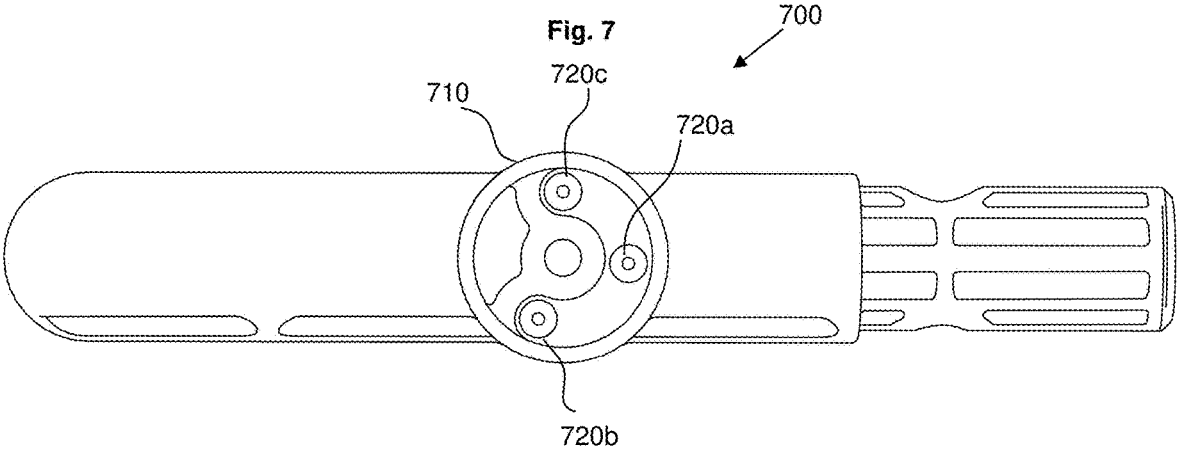
FIG. 7 is a side view of pivot connection part forming part of the stand for the rocker/bouncer.
Figure 8:
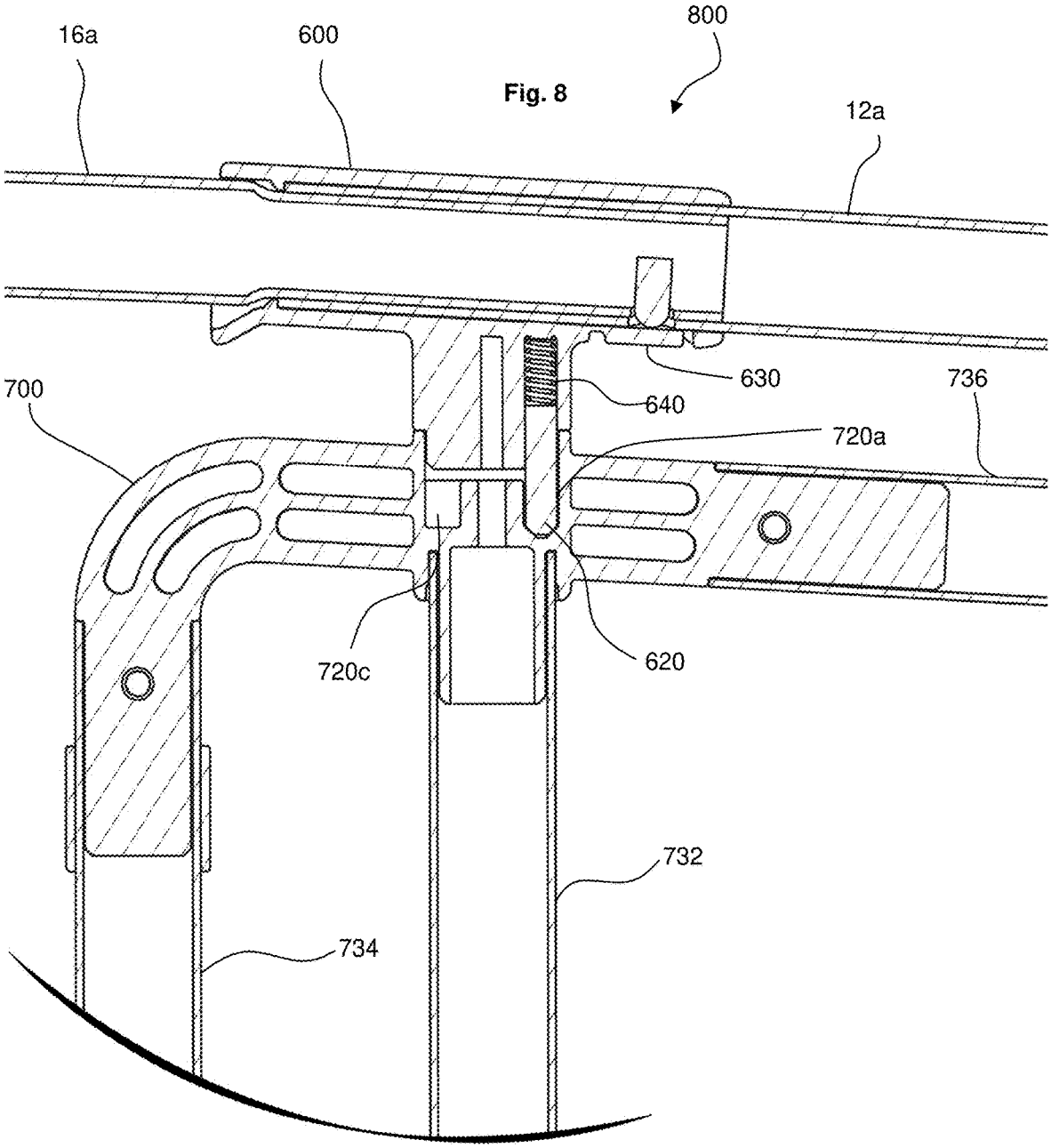
FIG. 8 is a top, cross-sectional view of an adjustment mechanism for the stand of the rocker/bouncer.

Referring now to FIGS. 6, 7 and 8, the push fit connector 600, may comprise a frame pivot portion 610. A pivot connection part 700 of the stand 30 may comprise a stand pivot portion 710. The stand pivot portion 710 may be pivotally couplable to the frame pivot portion 610 to permit pivotal movement of the stand 30 relative to the fame 10, e.g. about the stand pivot axis 32.

The stand 30 may comprise a pivot connection part 700 provided on either lateral side of the stand 30 for pivotally connecting the stand 30 to the frame 10 at either lateral side of the frame. For example, the pivot connection parts 700, e.g. the stand pivot portions 710, may be for connecting to respective ones of the push fit connectors 600, e.g. the frame pivot portions 610, provided on respective lateral sides of the frame.

The stand 30 may comprise a first, second and third stand frame members 732, 734, 736 extending between the pivot connection parts 700 on either lateral side. As depicted, the first stand frame member 732 may be aligned, e.g. axially aligned, with the stand pivot portion 710. For example, the first stand frame member 732, e.g. a central axis of the first stand frame member 732, may be aligned with the stand pivot axis 32. The second stand frame member 734 and the third frame member 736 may be arranged on opposite sides of the stand pivot axis from one another.

The second stand frame member 734 may be arranged such that the second frame member is positioned below the rails 12*a*, 12*b* when the stand is in the first deployed position and the third stand fame member 736 may be arranged such that the third frame member is positioned below the rails 12*a*, 12*b* when the stand is in the second deployed position. The third stand frame member 736 may extend further from the stand pivot axis 32 than the second frame member 736. In other words, the second stand frame member 734 may form the first stand portion 34 and the third stand frame member 736 may form the second stand portion 36.

As depicted, the first, second and third stand frame members 732, 734, 736 may be substantially circular tubular frame members. However, in other arrangements, the stand frame members may be any other shape or combination of shapes.

The rocker/bouncer 2 may further comprise an adjustment mechanism 800 for selectively securing the stand 30 in the stowed position and the first and second deployed positions. In some arrangements, one of the adjustment mechanisms 800 may be provided on each lateral side of the rocker/bouncer 2.

In the arrangement shown, the adjustment mechanism 800 comprises a pin 620 and a plurality of openings 720*a*, 720*b*, 720*c*. The openings are arranged so that the pin 620 can be received within respective ones of the openings 720*a*, 720*b*, 720*c* when the stand is in the stowed position, and in the first and second deployed positions. When the pin 620 is received within one of the openings 720*a*, 720*b*, 720*c*, engagement between the pin 620 and the opening, e.g. an internal wall of opening, may act to resist or prevent movement, e.g. pivoting, of the stand 30 relative to the frame 10. In particular, when the pin 620 is received within one of the openings 720*a*, 720*b*, 720*c*, engagement between the pin 620 and the opening may act to resist or prevent movement of the stand 30 between the stowed position, first deployed position and second deployed position.

In the arrangement depicted, the pin 620 is movably coupled to the frame 10, e.g. the push fit connector 600, and the openings 720*a*, 720*b*, 720*c* are provided on the stand 30, e.g. on the pivot connection part 700. However, in other arrangements, the pin may be movably coupled to the stand, e.g. the pivot connection part 700, and the openings may be provided on the frame 10, e.g. on the push fit connector 600.

The frame 10 may further comprise an adjustment actuator 630, such as a button, which may be pressed by a user in order to displace the pin 620, so that the pin 620 becomes disengaged from a particular one of the openings 720*a*, 720*b*, 720*c* in which the pin is received, or does not become engaged with one of the openings, to thereby permit movement, e.g. pivoting, of the stand 30 relative to the frame 10. As depicted, the adjustment actuator 630 may be provided on, e.g. mounted on or integrally formed with, the push fit connector 600. However, in other arrangements, the adjustment actuator 630 may be provided on the stand 20, on the frame 10, or any other component of the rocker/bouncer 2. Furthermore, in some arrangements, the pin 620 may be movably coupled to a frame member of the frame. In some arrangements, for example, the push fit connections 600 may be omitted from the frame. In such arrangements, the frame pivot part 610 may be integrally formed with a frame member of the frame.

In arrangements in which the pin 620 is movably coupled to the stand 30, the adjustment actuator 630 may be provided on the stand 30, e.g. on the pivot connection part 700.

The adjustment mechanism 800 may further comprise a biasing member 640, e.g. a resilient element, such as a spring, configured to bias the pin 620 into a position in which the pin can be received within the openings 720*a*, 720*b*, 720*c*.

Returning to FIGS. 2, 3 and 4, the frame 10, e.g. the base 14, may comprise one or more first foot portions 14*a*. The first foot portions 14*a* may project downwardly from the base frame members 12, e.g. towards the ground surface. The first foot portions 14*a* may be arranged towards a front of the frame 10, e.g. forwards of the stand 30. When the stand 30 is in the stowed position, the rocker/bouncer may be configured to rock on the one or more rails 12*a*, 12*b* between a forward position, in which the one or more first foot portions 14*a* contact the ground surface, and a rearward position, in which the first foot portions 14*a* do not contact the ground surface.

Figure 3A:
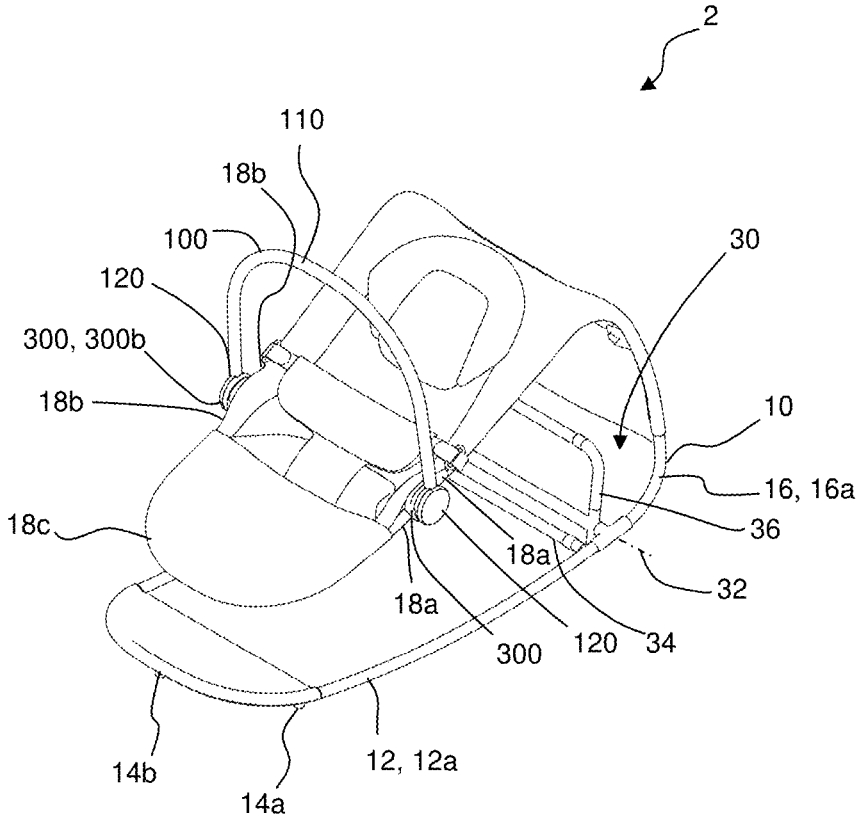
FIGS. 3*a* and 3*b*, collectively referred to as FIG. 3 are perspective and side views of the rocker/bouncer for a child, according to arrangements of the present disclosure, with the stand in a second configuration.
Figure 3B:
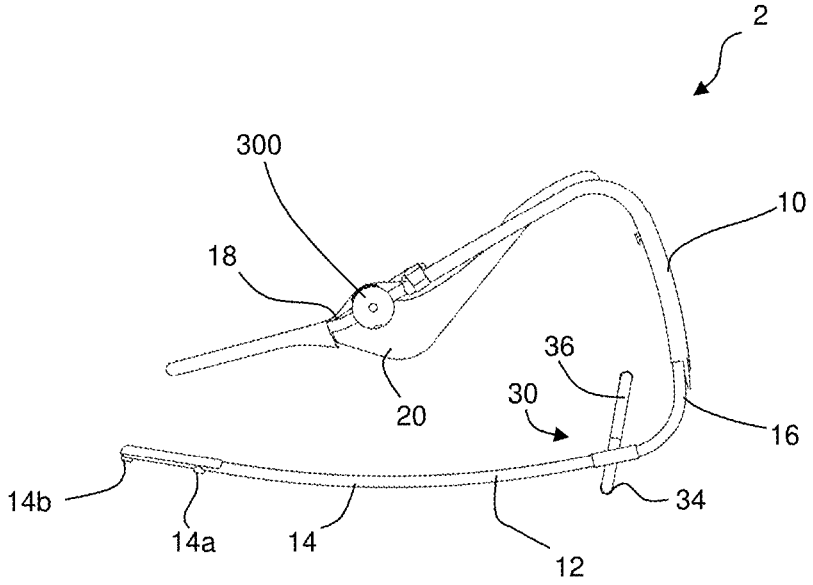

When the stand 30 is in the first deployed position, as depicted in FIGS. 3*a* and 3*b*, the stand and the first foot portions 14*a* may be configured to contact the ground surface, e.g. simultaneously, to resist or prevent rocking of the rocker/bouncer 2 over the rails 12*a*, 12*b*.

The frame, e.g. the base 14, may further comprise one or more second foot portions 14*b*, the second foot portions 14*b* may be arranged forwards of the first foot portions 14*a*, e.g. on an opposite side of the first foot portions 14*a* from the stand 30. Similarly to the first foot portions 14*a*, the second foot portions 14*b* may project downwardly from the base frame members 12, e.g. towards the ground surface.

Figure 4A:
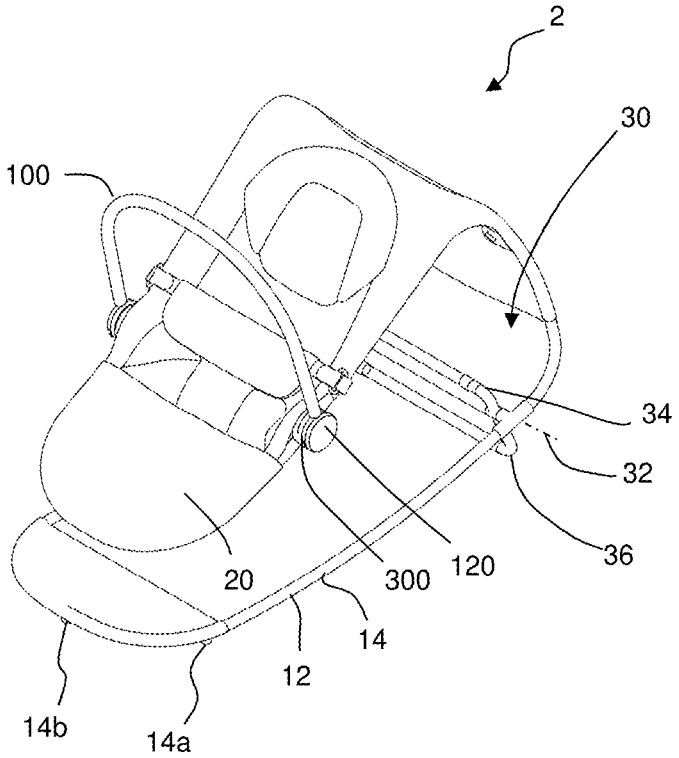
FIGS. 4*a* and 4*b*, collectively referred to as FIG. 4, are perspective and side views of the rocker/bouncer for a child, according to arrangements of the present disclosure, with the stand in a third configuration.
Figure 4B:
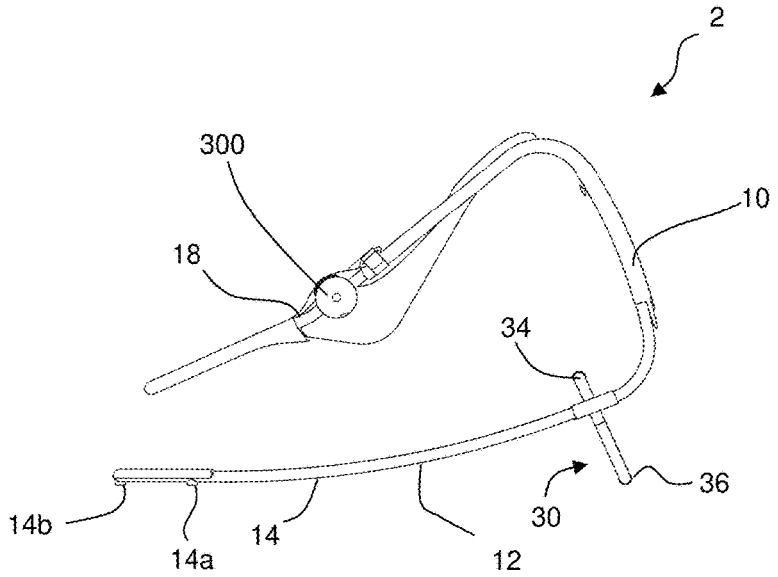

When the stand 30 is in the second deployed position, as depicted in FIGS. 4*a* and 4*b*, the stand, the first foot portion and the second foot portions may be configured to contact the ground surface, e.g. simultaneously, to resist or prevent rocking of the rocker/bouncer 2 over the rails 12*a*, 12*b*, and to support the seat 20 in an inclined orientation, e.g. relative to when the stand 30 is in the first deployed position or stowed position.

In other arrangements, the second foot portions 14*b* may be omitted and, when the stand is in the second deployed position, the stand, the first foot portions and a portion of the base 14, e.g. one the one or more rails 12*a*, 12*b*, forwards of the first foot portions 14*a* may be configured to contact the ground surface, e.g. simultaneously, to resist or prevent rocking of the rocker/bouncer 2 over the rails 12*a*, 12*b*, and to support the seat 20 in an inclined orientation, e.g. relative to when the stand is in the first deployed position and stowed position.

The portion of the one or more rails on the forwards of the first foot portions 14*a* may be shaped such that the portion is in contact with the ground surface along a continuous length of the portion between the first foot portions and a forward extent of the base 14, e.g. of the rails 12*a*, 12*b*.

The following additional numbered statements also form part of the present disclosure:

Statement 1. Furniture for a child, the furniture comprising:

a frame;

a seat coupled to the frame, wherein the seat is for supporting the child on the furniture; and a toy bar for supporting toys on the furniture, wherein the toy bar is magnetically couplable to the seat and/or frame.

Statement 2. The furniture of statement 1, wherein the frame or seat comprises a toy bar connection portion and wherein the toy bar comprises a connecting part configured to magnetically couple to the toy bar connection portion.

Statement 3. The furniture of statement 2, wherein the connecting part of the toy bar comprises an engagement face and the toy bar connection portion comprises a complementary engagement face, wherein the furniture is configured such that the engagement face engages the complementary engagement face when the toy bar is coupled to the seat and/or frame.

Statement 4. The furniture of statement 3, wherein the engagement face and the complementary engagement face are substantially planar.

Statement 5. The furniture of statement 3 or 4, wherein one of the connecting part and the toy bar connection portion comprises a protruding portion protruding outwardly relative to the engagement face or the complementary engagement face, and the other of the connecting part and the toy bar connection portion comprises a recess for receiving the protruding portion when the toy bar is in a first position and/or orientation relative to the frame and/or seat, and wherein the protruding portion and the recess are configured to engage one another in order to resist movement of the toy bar relative to the frame and seat.

Statement 6. The furniture of statement 5, wherein a magnet of the magnetic coupling is configured to resist movement of the toy bar relative to the frame and/or seat in a first direction, and the protruding portion and the recess are configured to engage one another in order to resist movement of the toy bar relative to the frame and seat in a second direction, perpendicular to the first direction and/or resist rotation of the toy bar about an axis with a component in the first direction.

Statement 7. The furniture of statement 5 or 6, wherein the other of the connecting part and the toy bar connection portion comprises a further recess for receiving the protruding portion when the toy bar is arranged in a second position and/or orientation relative to the frame and seat.

Statement 8. The furniture of statement 7, wherein the frame comprises a base to be placed on a ground surface, wherein when the toy bar is in the first position and/or orientation, at least a portion of the toy bar is positioned on an opposite side of the seat from the base, and when the toy bar is in the second position and/or orientation, the toy bar or portion thereof is closer to the base.

Statement 9. The furniture of statement 7 or 8, wherein when the toy bar is in the first position and/or orientation, the toy bar is arranged at an angle relative to a member of the frame and wherein when the toy bar is in the second position, the toy bar is at least partially aligned with a member of the frame.

Statement 10. The furniture of statement 9, wherein when the toy bar is in the first position and/or orientation, the toy bar is arranged at an angle relative to a member of the frame to which the seat is coupled and wherein when the toy bar is in the second position and/or orientation, the toy bar is at least partially aligned with the member of the frame to which the seat is coupled.

Statement 11. The furniture of any of the preceding statements, wherein the furniture comprises a rocker/bouncer.

Statement 12. The furniture of any of the preceding statements, wherein the furniture comprises two toy bar connection portions on either side of the seat.

Statement 13. The furniture of any of the preceding statements, wherein the toy bar comprises a pair of connecting parts configured to connect to toy bar connection portions on either side of the seat.

Statement 14. A toy bar for furniture for a child, wherein the toy bar comprises:

a bar part; and one or more connecting parts comprising one or more magnets or elements of a magnetically attractive material for magnetically connecting the toy bar to toy bar connection parts provided on the furniture.

Statement 15. The toy bay of statement 14, wherein the connecting parts comprise an engagement face configured to engage a complementary engagement face on the furniture when the toy bar is coupled to a seat and/or frame of the furniture.

Statement 16. The toy bar of statement 15, wherein the connecting parts comprise one of:

a protruding portion, protruding outwardly relative to the engagement face to be received within a recess formed on the connection parts provided on the frame, and a recess for receiving a protruding portion formed on the connection parts provided on the frame, wherein the one of the protruding portion and the recess are configured to engage the other of the protruding portion and the recess formed on the connection parts provided on the frame to resist movement of the toy bar relative to the frame and seat of the furniture.

Statement 17. The toy bar of statement 16, wherein one or more of the magnets or elements of magnetically attractive material is configured to resist movement of the toy bar relative to the frame and seat in a first direction, and the protruding portion and the recess are configured to engage one another in order to resist movement of the toy bar relative to the frame and seat in a second direction, perpendicular to the first direction and/or resist rotation of the toy bar about an axis with a component in the first direction.

It will be appreciated by those skilled in the art that although the invention has been described by way of example, with reference to one or more exemplary examples, it is not limited to the disclosed examples and that alternative examples could be constructed without departing from the scope of the invention as defined by the appended claims.

The invention claimed is:

1. A rocker/bouncer for a child, the rocker/bouncer comprising:

a base, wherein the base comprises one or more rails on which the rocker/bouncer can rock when the base is placed on a ground surface;

a seat for the child, wherein the seat is coupled to the base by a resilient member; and an adjustment member movably coupled to the base, wherein the adjustment member is selectively movable between:

a stowed position;

a first deployed position, in which the adjustment member protrudes from the one or more rails towards the ground surface by a first distance; and a second deployed position, in which the adjustment member protrudes from the one or more rails towards the ground surface by a second distance different from the first distance;

wherein the base comprises a foot portion, wherein when the adjustment member is in the stowed position, the rocker/bouncer is able to rock on the one or more rails between a first position in which the foot portion contacts the ground surface, and a second position, in which the foot portion does not contact the ground surface;

wherein when the adjustment member is in the second deployed position, the adjustment member, the foot portion, or a portion of the base, on an opposite side of the foot portion from the adjustment member are configured to contact the ground surface simultaneously to resist rocking of the rocker/bouncer on the rails and support the seat in an inclined orientation; and wherein the portion of the base on the opposite side of the foot from the adjustment member is shaped such that the portion is in contact with the ground surface along a continuous length of the portion between the foot and a forward extent of the base.

2. The rocker/bouncer of claim 1, wherein the adjustment member is securable in the stowed position, the first deployed position and the second deployed position.

3. The rocker/bouncer of claim 1, wherein the adjustment member is configured to contact the ground surface when in the first and second deployed positions in order to adjust an angle of inclination of the seat relative to the ground surface.

4. The rocker/bouncer of claim 1, wherein the adjustment member is rotatably coupled to the base, wherein the adjustment member is rotatable relative to the base between the stowed position and the first and second deployed position.

5. The rocker/bouncer of claim 4, wherein the first deployed position of the adjustment member is at an angle of approximately 180 degrees relative to the second deployed position.

6. The rocker/bouncer of claim 1, wherein when the adjustment member is in the first deployed position, the adjustment member and foot portion are configured to contact the ground surface to resist rocking of the rocker/bouncer on the rails.

7. The rocker/bouncer of claim 1, wherein the rocker/bouncer further comprises a resilient connecting portion arranged to couple the seat to the base, wherein the resilient connecting portion is at a rearward extent of the rocker/bouncer.

8. The rocker/bouncer of claim 1, wherein the rocker/bouncer is free from connections between the seat and the base at positions on the seat forwards of a central position of the rocker/bouncer.

* * * * *